US007287578B2

(12) United States Patent
Ricci et al.

(10) Patent No.: US 7,287,578 B2
(45) Date of Patent: Oct. 30, 2007

(54) CONNECTION BETWEEN A COOLED DOUBLE-WALL PIPE AND AN UNCOOLED PIPE AND DOUBLE-PIPE HEAT EXCHANGER INCLUDING SAID CONNECTION

(75) Inventors: Pierluigi Ricci, Crema (IT); Luca Zanardi, Bergamo (IT); Gaetano Galatello Adamo, Lissone (IT)

(73) Assignee: OLMI S.p.A., Suisio (BG) (IT)

( * ) Notice: Subject to any disclaimer, the term of this patent is extended or adjusted under 35 U.S.C. 154(b) by 479 days.

(21) Appl. No.: 10/872,447

(22) Filed: Jun. 22, 2004

(65) Prior Publication Data

US 2005/0178535 A1 Aug. 18, 2005

(30) Foreign Application Priority Data

Feb. 18, 2004 (IT) ..... MI2004A0272

(51) Int. Cl.
*F28D 7/10* (2006.01)

(52) U.S. Cl. ..... 165/154; 165/178; 285/123.15

(58) Field of Classification Search ..... 165/154, 165/155, 178; 285/123.15
See application file for complete search history.

(56) References Cited

U.S. PATENT DOCUMENTS 3,934,618 A * 1/1976 Henderson ..... 138/114
4,437,513 A * 3/1984 Castiglioni et al. ..... 165/154
4,648,355 A * 3/1987 Bekedam ..... 122/412
4,778,002 A * 10/1988 Allgauer et al. ..... 165/141
4,862,955 A * 9/1989 Itakura ..... 165/155
5,097,898 A * 3/1992 Verkaart ..... 165/154
5,287,913 A * 2/1994 Dunning et al. ..... 165/243
5,579,831 A * 12/1996 Brucher ..... 165/134.1
5,690,168 A * 11/1997 Cizmar et al. ..... 165/134.1
5,740,857 A * 4/1998 Thompson et al. ..... 165/47

* cited by examiner

*Primary Examiner*—Leonard R Leo
(74) *Attorney, Agent, or Firm*—Jacobson Holman PLLC

(57) ABSTRACT

A connection between an uncooled pipe and a cooled double-wall pipe with between the walls a hollow space run through by cooling fluid let into the hollow space and taken from the hollow space through side passages connected to cooling fluid inlet and outlet ducts and including a connection zone with longitudinal cross section generally in fork form to have single tubular end connected to the uncooled pipe and an opposite double-wall tubular end to which are connected the corresponding walls of the cooled double-wall pipe so that the fork bottom constitutes a terminal closing of the hollow space and a side passage is made opposite the connection and a portion thereof nearest the uncooled pipe is almost at the height of the fork bottom. A double-pipe heat exchanger includes such a connection.

18 Claims, 2 Drawing Sheets

CONNECTION BETWEEN A COOLED DOUBLE-WALL PIPE AND AN UNCOOLED PIPE AND DOUBLE-PIPE HEAT EXCHANGER INCLUDING SAID CONNECTION

BACKGROUND OF THE INVENTION

1. Field of the Invention

The present invention relates to the connections between an uncooled single-wall pipe and a cooled double-wall pipe to be used for realizing double-pipe heat exchangers termed also Linear Quench Exchangers (LQE). More generally, the present invention also relates to double-pipe exchangers including said connections.

2. State of the Prior Art

In the prior art, the problems had at connections between cooled pipes and uncooled pipes in double-pipe LQE heat exchangers are known. Indeed, the cooled pipe is typically realized with two coaxial pipes with the innermost of these defining in it a duct run through by the hot fluid (for example gas coming out of a furnace), while the outermost delimits the hollow space in which runs the cooling fluid (for example water). Said cooling fluid is let into the hollow space through a connection in the side wall of the external jacket near the inlet end of the cooled double-wall pipe. Then, typically, the cooling fluid is taken from the hollow space near the outlet end of the double-wall pipe. This "double-wall" structure upstream must be connected with an uncooled "single-wall" pipe carrying in it the hot fluid to be cooled and which therefore is at a relatively high temperature.

To achieve connection between the pipes, a connection member with a first single-wall tubular end on which is welded the uncooled pipe and a double-wall opposite end with two concentric walls on which are welded respectively an internal pipe and an external jacket of the cooled double-wall pipe is generally used. The longitudinal cross section of the connection member can be assimilated with that of a fork.

In this type of connection between a hot single-wall inlet pipe and a cooled double-wall pipe the walls of the pipes and the forked connection in the contiguous points have different temperatures that produce swelling harmful for the strength of the coupling. In addition, the welds between the cooled pipe and the forked connection are in a not well-cooled zone since the connection for cooling fluid inlet to the hollow space is located further along in the cooled pipe.

In the prior art it was sought to remedy this situation by placing in the internal zone of the fork a refractory material which would reduce heat transmission toward the weld zones.

It was also proposed to connect the forked member and the cooled pipe only at the external jacket of the cooled pipe so as to allow independent thermal swelling for the inner parts of the pipe and the connection which are in contact with the hot fluid. This of course requires that the cooling hollow-space in the cooled pipe be closed at the end of the pipe before it reaches the connection member. Otherwise, the hydraulic seal between the cooled-pipe interior (run through by hot fluid) and the hollow space of the cooling fluid would be lacking. In addition, another hollow space more or less open to the hot fluid and containing the refractory would be created, would disturb the flow and might set off coke formation.

But in addition to the complexity and cost of realization, such a solution suffers from periodic breakage of the refractory material which must therefore be replaced with not negligible work and cost. In addition, the fork branches receiving the insulation must be relatively long to receive insulation material in adequate quantities and move the connection between the fork connection and the cooled pipe far enough from the hot zone. This involves further increase in the costs of the connection since due to its nature the forked member must be made of better and therefore more costly material compared to the rest of the structure.

Heat exchangers of the LQE type, in addition to problems related to the connection between the uncooled inlet pipe and the cooled double-wall pipe, also display some problems at the connection between the double-wall pipe and the cooled single-wall fluid outlet pipe. Indeed, near these connections a side passage designed to supply a way out for the cooling fluid that has run through the hollow space of the exchanger is created on the outer wall of the double pipe. The cooling-fluid side passage outlet in prior art heat exchangers is arranged upstream of the terminal part of the hollow space along the double-wall pipe. This fact can lead to the formation of steam bubbles downstream of the outlet passage or, in any case, to the formation of cooling fluid stagnation zones on the bottom of the hollow space, thus nullifying the good operation of the heat exchanger.

The general purpose of the present invention is to remedy the above mentioned shortcomings by making available a stout and relatively economical connection between an uncooled single-wall pipe and a cooled double-wall pipe at the inlet of the LQE heat exchangers.

Another purpose of the present invention is to make available connections between a cooled double-wall pipe and an uncooled pipe which would avoid the formation of cooling fluid stagnation zones or steam bubbles in the hollow space of the cooled pipe.

SUMMARY OF THE INVENTION

In view of this purpose it was sought to provide in accordance with the present invention a connection between an uncooled pipe and a cooled double-wall pipe with a hollow space between the walls run through by the cooling fluid let into the hollow space and taken from the hollow space through side passages connected to cooling fluid inlet and outlet ducts and comprising a connection zone with a longitudinal cross section generally in fork form to have a single tubular end connected to the uncooled pipe and an opposite double-wall tubular end to which are connected the corresponding walls of the cooled double-wall pipe so that the bottom of the fork constitutes a terminal closure of the hollow space and characterized in that a side passage is made at the connection and a portion thereof nearest the uncooled pipe is almost at the height of the fork bottom.

BRIEF DESCRIPTION OF THE DRAWINGS

To clarify the explanation of the innovative principles of the present invention and its advantages compared with the prior art there is described below with the aid of the annexed drawings a possible embodiment thereof by way of non-limiting example applying said principles. In the drawings.

DETAILED DESCRIPTION OF THE INVENTION

Figure 1:
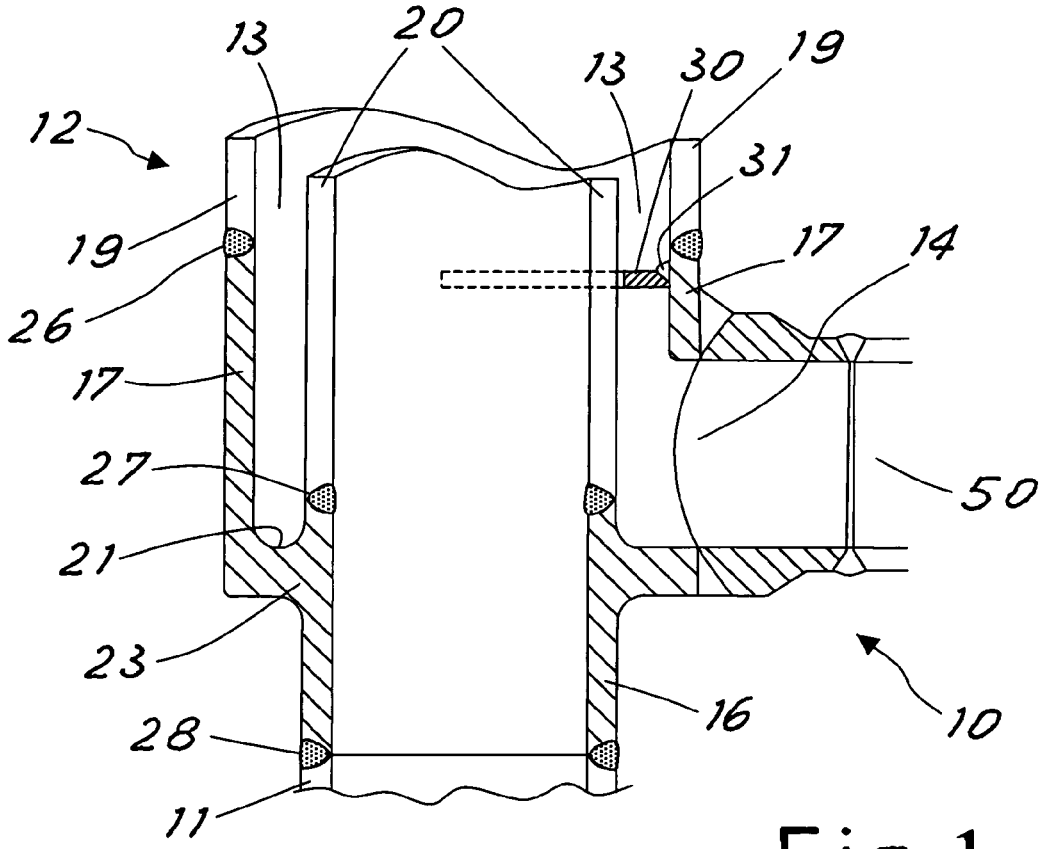
FIG. 1 shows a longitudinal cross section view of a connection at the inlet of an LQE heat exchanger in accordance with the present invention.

With reference to the figures, FIG. 1 shows a connection 10 between an uncooled single-wall pipe 11 and a cooled double-wall pipe 12 at the inlet of an LQE heat exchanger. The double-wall pipe 12 comprises an external wall 19 or jacket and an internal tubular wall 20 defining the duct in which flows the hot fluid to be cooled arriving from the single-wall pipe 11. Advantageously the external wall 19 and the internal wall 20 are arranged coaxially to define a hollow space with cylindrical symmetry 13. During operation of the heat exchanger, the cooling fluid (typically water) inlet to the hollow space through a side passage 14 in accordance with the procedure set forth below runs in the hollow space 13.

In an embodiment in accordance with the present invention the connection is realized with a connection member 23 having a longitudinal cross section generally shaped like a fork. Said connection member 23 as shown in FIG. 1 comprises a single tubular end 16 connected to the uncooled pipe 11 and an opposite double-wall tubular end 17, 18 to which are connected the corresponding walls 19, 20 of the cooled double-wall pipe 12. In this manner the bottom 21 of the fork defined by the connection member 23 constitutes the terminal closure part of the hollow space 13 of the double-wall pipe 12. Advantageously the connections between the tubular ends 17, 18 of the connection member 23 and of the corresponding walls 19, 20 of the double-wall pipe 12 are realized with the welds 26 and 27 respectively. Similarly, the single tubular end 16 is welded to the hot fluid inlet pipe 11 by the weld 28. It should be noted that the welds 27 are preferably nearer the bottom 21 of the hollow space 13 than the welds 26 as shown in FIG. 1.

The side passage 14 for cooling fluid inlet into the hollow space 13 in accordance with the present invention is located at the connection 10. In particular, the side passage 14 is made on the external wall 17 of the forked connection member 23 and has a lower portion located at the height of the bottom 21 of the fork. The passage 14 is fed by a cooling-fluid duct 50 having its axis perpendicular to the axis of the connection 10 and of the double-wall pipe 12. In this manner the flow of cold fluid into the hollow space 13 is started directly toward the bottom 21 of the connection fork 10 to allow advantageously reducing the temperature of the forked connection member 23 to avoid harmful transmission of heat into the connection body. In a preferred embodiment of the present invention the bottom 21 of the fork is nearly contained in a plane perpendicular to the axis of the connection 10 and parallel to the axis of the cooling fluid intake duct 50.

Figure 2:
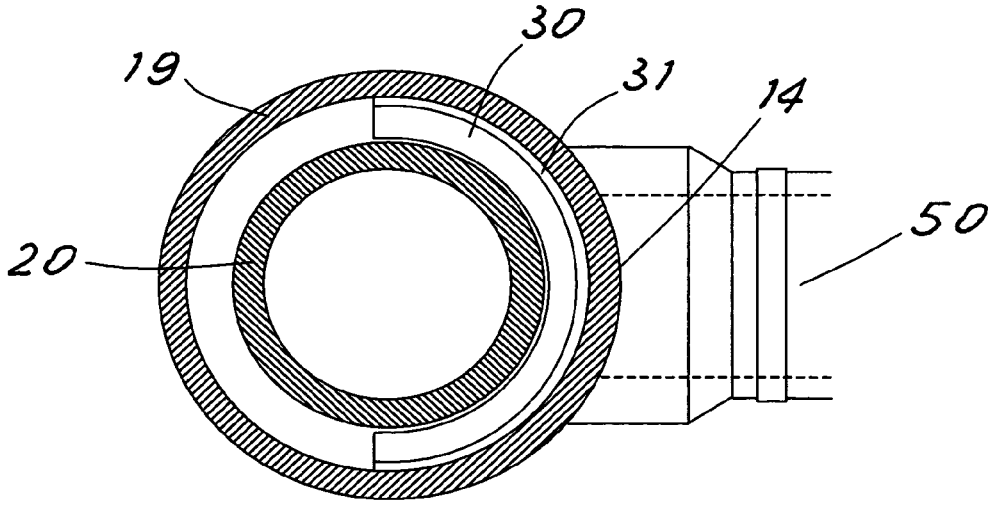
FIG. 2 shows a cross section view of a connection of FIG. 1.

In a preferred embodiment of the present invention, in the hollow space 13 is arranged a baffle 30 designed to force the fluid inlet from the side passage 14 to strike all the portions of the bottom 21 of the hollow space 13 including those most remote from the passage 14. Said baffle 30 advantageously describes an 180° arc of a circle and embraces the half of the internal pipe 20 of the double-wall pipe 12 turned towards the side passage 14. In accordance with FIGS. 1 and 2, the baffle is all but contained in a plane perpendicular to the axis of the double-wall pipe 12 and is arranged near the side passage 14 at a height just above it. Advantageously, as shown in FIG. 2, the thickness of the baffle 30 is such as to nearly entirely close the hollow space 13 for approximately half of its angular extension. In this manner the cooling fluid is forced to transit in the terminal part of the hollow space 13 farther from the side passage 14 to allow effective cooling also of the parts of the bottom 21 farther from the passage 14.

In a preferred embodiment of the present invention the baffle 30 is fixed to the external portion 17 of the connection member 23 by the weld 31 as shown in FIGS. 1 and 2.

Figure 3:
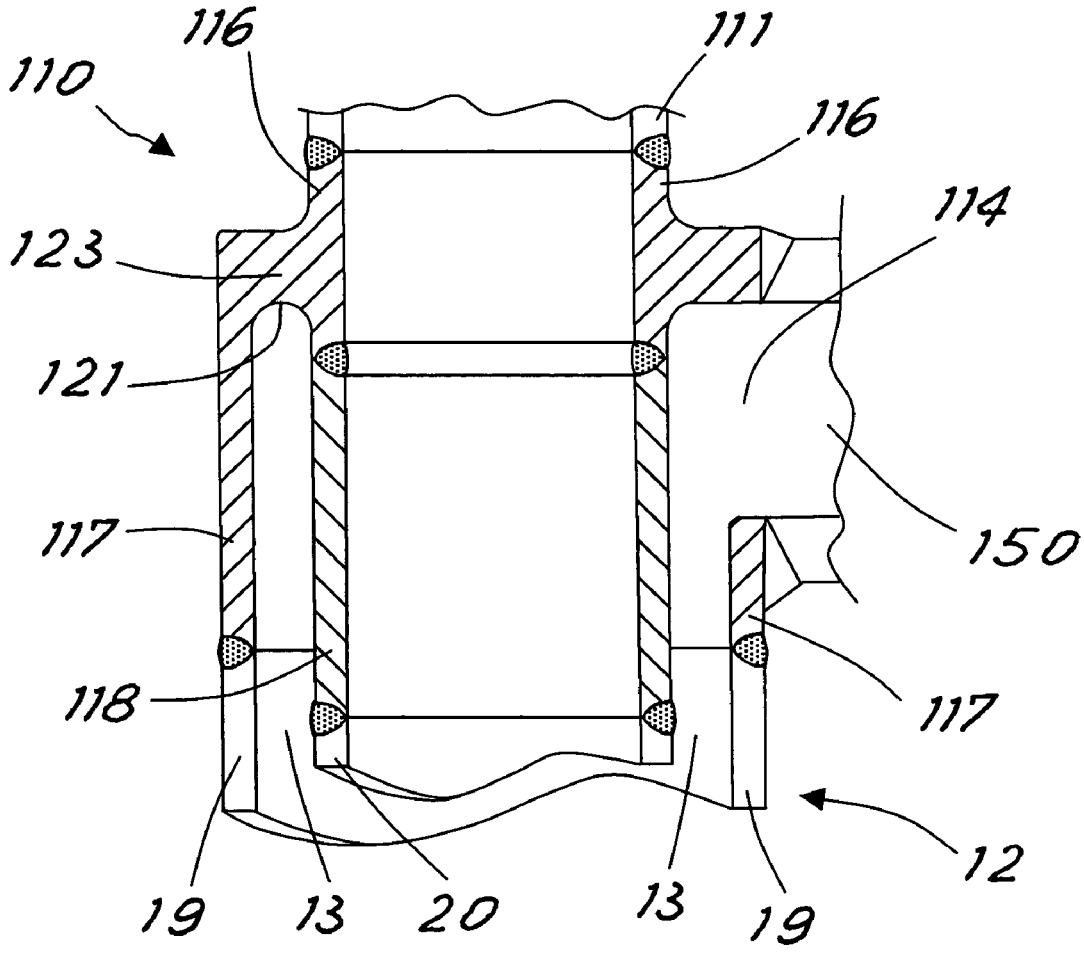
FIG. 3 shows a longitudinal cross section view of an outlet connection of an LQE heat exchanger in accordance with the present invention.

FIG. 3 shows the connection 110 connecting the single-wall pipe 111 for outlet of the cooled fluid to the double-wall pipe 12. At this second connection of the heat exchanger there is the side passage 114 designed to take the cooling fluid that has run through the hollow space 13. Similarly to what took place for the heat exchanger inlet connection, the connection is realized with a generally fork-shaped connection 123 having a single-wall tubular end 116 welded to the outlet pipe 111 and a double-wall tubular end 117, 118 with walls welded to the corresponding double walls 19, 20 of the double-wall pipe 12. The connection member is such as to form the closing terminal part of the hollow space 13 with its fork bottom 121 similarly to what took place for the forked connection member 23. Again in this case, the side passage 150 is made on the external wall 117 of the connection member near the bottom of the fork 121. In particular, the passage is formed so that its portion nearest the single-wall pipe 111 is at the height of the fork bottom 121. In this manner all the cooling fluid after traveling the longitudinal extension of the hollow space 13 traverses the side passage 114 to which is connected a cooling fluid outlet duct 150 having its axis perpendicular to the axis of the connection 110 and of the double-wall pipe 12. This contrivance avoids formation of steam bubbles at the terminal end of the hollow space 13 or in any case creation of cooling fluid stagnation zones at the outlet of the exchanger.

It is now clear that the predetermined purposes have been achieved. In particular, thanks to the special form of the connection on the hot side of the exchanger the connection zone is cooled effectively by the same process fluid and no layer of refractory is necessary in the bottom of the fork or other systems to keep the temperatures low. This bottom can be of slight depth to the advantage of both cooling and material economy.

It was surprisingly found that a connection realized in this manner although not having all the complications of prior art connections is exceptionally stout and long-lived as it has no points of maximum thermal stress as were found in connections made in accordance with the prior art and which were responsible for the unavoidable periodic breaks. Naturally the above description of an embodiment applying the innovative principles of the present invention is given by way of non-limiting example of said principles within the scope of the exclusive right claimed here. For example the proportions of the parts could vary depending on specific practical requirements.

What is claimed is:

1. Connection between a single wall of an uncooled pipe and two walls of a cooled double-wall pipe having a hollow space run through by a cooling fluid let into the hollow space and taken from the hollow space through side passages connected to a cooling fluid inlet duct and a cooling fluid outlet duct in a linear quench exchanger, said connection comprising a connection zone with a longitudinal cross section generally in a fork form having a single tubular end connected by a weld to the uncooled pipe and an opposite double-wall tubular end connected to the two walls of the cooled double-wall pipe by plural welds so that a bottom of the fork form constitutes a terminal closing of the hollow space and a side passage is present at the connection to the double-wall pipe and a portion thereof nearest the uncooled pipe is almost at a height of the bottom of the fork.

2. Connection in accordance with claim 1, wherein the side passage is a passage for entry of the cooling fluid into the hollow space.

3. Connection in accordance with claim 2, further comprising a baffle arranged in the hollow space near the side passage to guide flow of cooling fluid near the fork form bottom.

4. Connection in accordance with claim 3, wherein the baffle describes an arc of approximately 180° to embrace half of a circumference of an inner wall of the hollow space on a side of the side passage.

5. Connection in accordance with claim 3, wherein the baffle is fastened on an external wall of the hollow space.

6. Connection in accordance with claim 2, wherein a fork connection zone is realized with a separate connection member generally in a fork form at one end of which is located the uncooled pipe and at an opposite end of which is located the double-wall pipe with an external wall of said opposite end of the connection member there is said side passage.

7. Connection in accordance with claim 6, wherein a welding zone between an external wall of the cooled double-wall pipe and the connection member is farther from the fork form bottom than a welding zone between an inner wall of the cooled double-wall pipe and the connection member.

8. Connection in accordance with claim 1, wherein the side passage is a passage for outlet of the cooling fluid from the hollow space.

9. Connection in accordance with claim 1, wherein the fork form bottom is nearly contained in a plane.

10. Connection in accordance with claim 9, wherein the cooling fluid duct has near the side passage an axis nearly parallel to the plane of the bottom of the fork form.

11. Connection in accordance with claim 9, wherein the plane of the bottom of the fork is perpendicular to an axis of the double-wall pipe.

12. Connection in accordance with claim 9, further comprising a baffle arranged in the hollow space near the side passage to guide flow of cooling fluid near the fork form bottom, said baffle is nearly contained in a plane parallel to the plane of the fork form bottom.

13. Connection in accordance with claim 12, wherein the baffle describes an arc of approximately 180° to embrace half of a circumference of an inner wall of the hollow space on a side of the side passage, and a thickness of the baffle is a little less than a thickness of the hollow space.

14. Connection in accordance with claim 1, wherein the cooling fluid duct has near the side passage an axis nearly perpendicular to an axis of the cooled double-wall pipe.

15. Double-pipe linear quench heat exchanger comprising a double-wall pipe for heat exchange between a fluid contained in an internal pipe of the double-wall pipe and fluid flowing in a hollow space between the internal pipe and an external pipe of the double-wall pipe with said double-wall pipe being connected by a weld to a single-wall pipe for inlet of fluid to be cooled through a first connection and being connected to a single-wall pipe by another weld for outlet of the cooled fluid through a second connection, said first connection between the single-wall pipe and the cooled double-wall pipe allowing the cooling fluid into the hollow space and taken from the hollow space through side passages connected to a cooling fluid inlet duct and a cooling fluid outlet duct, a connection zone with a longitudinal cross section generally in a fork form having a single tubular end connected to the single-wall pipe and an opposite double-wall tubular end connected to the cooled double-wall pipe by plural welds so that a bottom of the fork constitutes a terminal closing of the hollow space, a side passage being made at the first connection and a portion thereof nearest the single-wall pipe is almost at a height of the bottom of the fork.

16. Double-pipe linear quench heat exchanger in accordance with claim 15, wherein the side passage is a passage for entry of the cooling fluid into the hollow space and the cooling fluid duct has near the side passage an axis nearly perpendicular to an axis of the cooled double-wall pipe.

17. Double-pipe linear quench heat exchanger in accordance with claim 15, wherein the side passage is a passage for entry of the cooling fluid into the hollow space and in the hollow space is arranged a baffle near the side passage to guide the flow of cooling fluid near the fork bottom.

18. Double-pipe linear quench heat exchanger in accordance with claim 15, further comprising second connection between the single-wall pipe and the cooled double-wall pipe having a portion thereof nearest the single-wall pipe being almost at a height of the bottom of the fork form.

* * * * *